United States Patent [19]

Palmer

[11] 4,239,226

[45] Dec. 16, 1980

[54] RANDOM NUMBER GENERATOR

[76] Inventor: E. Frederick Palmer, 6905 Washington Ave., University City, Mo. 63130

[21] Appl. No.: 946,953

[22] Filed: Sep. 29, 1978

[51] Int. Cl.[3] ..... A63F 9/04

[52] U.S. Cl. ..... 273/146

[58] Field of Search ..... 273/146, 147, 138 R; 35/72, 70, 71; D21/41, 51

[56] References Cited

U.S. PATENT DOCUMENTS

| | | | |
|---|---|---|---|
| 809,293 | 1/1906 | Friedenthal | 273/146 |
| 1,571,901 | 2/1926 | Monson | 273/147 |
| 1,593,907 | 7/1926 | Madan | 273/146 |
| 3,233,343 | 2/1966 | Short | 273/146 X |
| 3,399,897 | 9/1968 | Mitchell | 273/146 |

*Primary Examiner*—Anton O. Oechsle
*Assistant Examiner*—Arnold W. Kramer
*Attorney, Agent, or Firm*—Polster, Polster and Lucchesi

[57] ABSTRACT

Random number generators are provided in the form of one or more ten-sided dice, made up of two, identical, regular, five-sided pyramids with planar bases face to face. The faces of each die on opposite sides of the equatorial plane defined by the bases are offset 36° from one another. The equatorial plane is perpendicular to a central axis extending through the apexes of the pyramids and bounded by a circle. The surface of the die immediately contiguous the equatorial plane is formed by a convex surface of revolution of an arc of finite radius, symmetrical with respect to the plane, about the axis.

5 Claims, 6 Drawing Figures

RANDOM NUMBER GENERATOR

BACKGROUND OF THE INVENTION

The idea of using a decahedron as a die is an old one as illustrated by U.S. Pat. to Friedenthal, No. 809,293 (1906). However, the Friedenthal die has the disadvantage as a random number generator of invariably tumbling from one side face to another, which can lead, wittingly or unwittingly to repetition in successive throws.

One of the objects of this invention is to provide a die which has improved random number generating characteristics.

Other objects will become apparent to those skilled in the art in the light of the following description and accompanying drawing.

SUMMARY OF THE INVENTION

In accordance with this invention, generally stated, a ten-sided die is provided, symmetrical about a center axis through the apexes of two regular five-sided pyramids joined base to base and rotated 36° with respect to one another. The die has an equatorial plane perpendicular to the central axis and bounded by a circle with the axis as a center. The circle has a radius no greater than that of a circle tangent to the projection on an extension of the equatorial plane, of the flat faces of the pyramid. The dimension of the die along the center axis is no less than the diameter of the circle. The faces bear indicia, preferably arabic numerals. The outer surfaces of the die immediately contiguous the equatorial plane are convex surfaces of resolution of an arc of finite radius, symmetrical with respect to the plane, about the center axis. Preferably, the opposite axial ends of the die are symmetrically rounded.

DESCRIPTION OF THE PREFERRED EMBODIMENT

Figure 1:
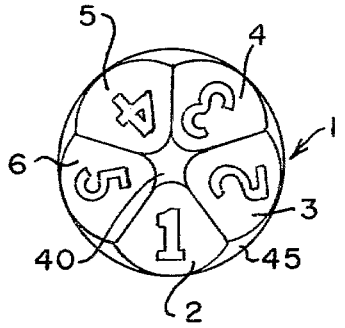
FIG. 1 is a top plan view of one embodiment of random number generating die of this invention.
Figure 3:
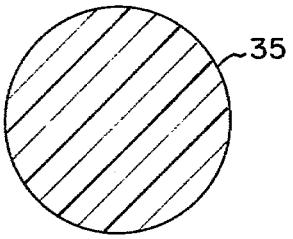
FIG. 3 is a sectional view taken along the line 3—3 of FIG. 2.
Figure 2:
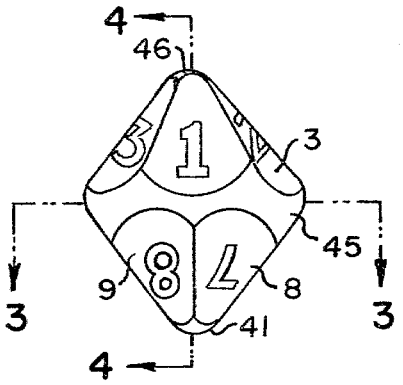
FIG. 2 is a view in side elevation.

Referring now to the drawing for one illustrative embodiment of random number generating die of this invention, reference numeral 1 indicates the finished die. The die 1 has ten faces indicated by the numerals 2 through 11, which in this embodiment carry, as indicia, arabic numerals 1 through 9, and zero, respectively.

Figure 4:
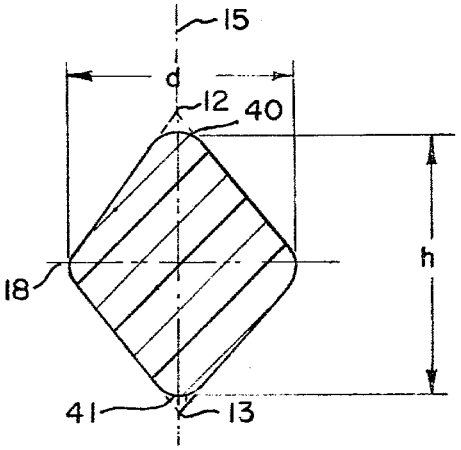
FIG. 4 is a sectional view taken along the line 4—4 of FIG. 2, with projections of the flat faces of the die indicated in dotted lines.
Figure 5:
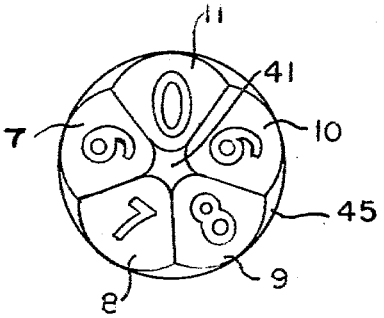
FIG. 5 is a bottom plan view, as viewed in FIG. 2.

The faces 2 through 11 are symmetrically arranged around a central axis 15, which extends through projected apexes 12 and 13, as shown in FIG. 4.

An equatorial plane 18, is perpendicular to the axis 15 and extends through the midpoint of the axis between the apexes 12 and 13.

The plane 18 is bounded within the die by a circular boundary 35.

Figure 6:
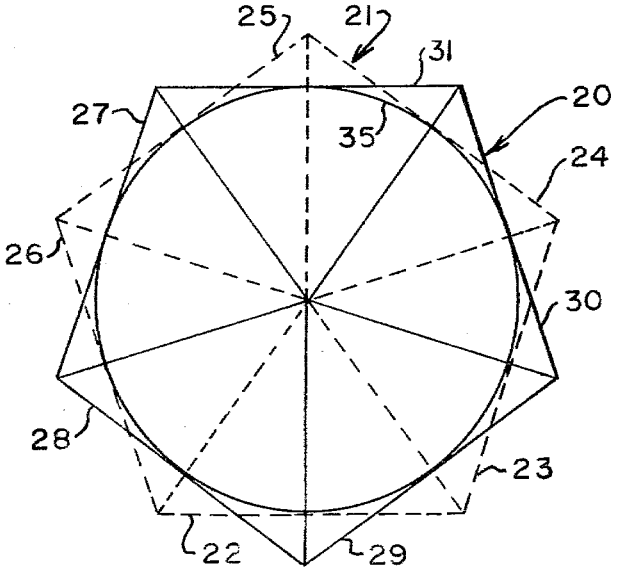
FIG. 6 is a plan view of the intersections of planes of the projected flat faces of the device upon an equatorial plane.

The projection of the planes of the faces 2 through 11 on an extension of the plane 18 is shown in FIG. 6. That projection produces two regular pentagons 20 and 21, made up of sides 22 through 31, corresponding to faces 2 through 11 respectively. The pentagons 20 and 21 are rotated 36° with respect to one another, so that a line from the axis to the intersection of two sides of one of the pentagons bisects and is perpendicular to a side of the other pentagon, all as shown in FIG. 6.

The diameter of the circular boundary 35 is no greater than the diameter of a circle tangent to all of the sides of the pentagons 20 and 21.

The height of the die is preferably no less than the diameter of the circular boundary 35.

The outer surface of the die immediately contiguous the central plane 18 is formed by a convex surface of revolution of an arc of finite radius, symmetrical with respect to the plane about the axis.

Preferably the opposite axial ends of the die are rounded symmetrically so as to provide hemispherical pole ends 40 and 41.

FIG. 1 shows the numbers 1, 2, 3, 4, and 5. The corresponding numbers of the associated parallel planes are:

Numbers shown on FIG. 1: 1 2 3 4 5

Numbers on associated parallel planes: 0 9 8 7 6

In making a die of this invention, or a master mold for such a die, one can make two symmetrical five-sided pyramids, and join them at their bases, in the configuration shown in FIG. 6. The ten-sided device thus produced can be chucked accurately to rotate on the axis 15, and the projecting arrises in the equatorial plane defined by the bases of the pyramids ground or turned off. The tool is then moved on a radius lying on the equatorial plane and in the plane defined by the intersection of the axis and the equatorial plane, to produce an arcuate belt 45 contiguous the equatorial plane, which is a surface of revolution, of the arc described by the tool, about the center axis.

The device can be re-chucked to rotate about the center axis, and the apexes, in the preferred embodiment, then ground or turned symmetrically to produce the hemispherical poles.

In generating random numbers, numbers from 0 through 9 (or 1 through 10) can be generated with a single die; from 0 through 99 (1 through 100), with 2; from 0 through 999 (1 through 1,000), with 3, etc.

"A Million Random Numbers" published by the Free Press, Glencoe, Illinois 1955 is a tabulation of five digit random numbers. In most problems in statistics, war gaming, management marketing probabilities, etc., a three digit number is adequate to express the probability that an event will occur. For example, the United States draft lottery was a tabulation of three digit numbers. The standing in a division of professional baseball teams is a tabulation of their winning percentages, expressed in three digit numbers. Likewise the batting percentages of professional baseball players are expressed in three digit numbers.

This random number generator therefore preferably consists of three dice, each with its distinctive color: red, white and blue. The three digit random number, a number from zero to 999, is read off in patriotic sequence—red, white, blue. Thus, in successive rolls of the dice, the hundreds digit is preferably always generated by the red die, the tens, by the white, and the units, by the blue die. Additional dice and colors could be added; however, in most statistical problems the three digit number is satisfactory.

It has been found that because of the circular section, the dice roll rather than tumble, although they may both roll and tumble. As a result, the numbers have been found to be truely random as measured against tables of random numbers in a series of 100 tosses, for example.

Numerous variations in the construction of the die of this invention within the scope of the appended claims will occur to those skilled in the art in the light of the foregoing disclosure. Merely by way of example, indicia different from arabic numerals can be used. The height to diameter ratio can be varied, although, preferably, for optimum results, the axial height to diameter ratio is in the range of 1:1 to 1.2:1 in terms of actual, as distinguished from the projected, height. These are merely illustrative.

Having thus described the invention what is claimed and desired to be secured by Letters Patent is:

1. A ten-sided die, having a center axis through the apexes of two regular five-sided identical pyramids, each with flat, planar faces and a planar base, joined base to base and rotated 36° with respect to one another, the equatorial plane defined by said bases being perpendicular to said axis, said plane being bounded by a circle with said axis as a center, said circle having a radius no greater than that of a circle tangent to the projection, on an extension of said plane, of the flat faces of said pyramids, the outer surface of said die immediately contiguous the said plane being formed by a convex surface of revolution of an arc of finite radius, symmetrical with respect to the plane, about said axis, whereby the boundary of each face along the said outer surface is arcuate, the dimension of said die along said center axis being no less than the diameter of said circle, and indicia on said faces.

2. The die of claim 1 wherein the opposite axial ends of said die are identically and symmetrically rounded, the distance between them being no less than the diameter of the circle bounding the said plane.

3. The die of claim 1 wherein the said indicia are numbers.

4. Dice of claim 1 each of a different color whereby numbers displayed on the uppermost face when the dice are at rest in successive rolls may be assembled in the same order by color of die.

5. The dice of claim 4 wherein three dice are red, white and blue respectively.

* * * * *